United States Patent [19]

Greaves

[11] Patent Number: 4,712,934

[45] Date of Patent: Dec. 15, 1987

[54] TYPEWRITER CARRIAGE ESCAPEMENT MECHANISM HAVING TWO SETS OF TEETH

[75] Inventor: Peter Greaves, Nottingham, England

[73] Assignee: Dobson Park Industries plc, Nottingham, United Kingdom

[21] Appl. No.: 802,031

[22] Filed: Nov. 26, 1985

[30] Foreign Application Priority Data

Nov. 28, 1984 [GB] United Kingdom ..... 8430084

[51] Int. Cl.[4] ..... B41J 19/48

[52] U.S. Cl. ..... 400/332.5; 400/330.7; 400/332.1; 400/332.3; 400/332.4; 400/332.6; 400/334.3

[58] Field of Search ..... 400/307.2, 330.5, 330.7, 400/332, 332.1, 332.2, 332.3, 332.4, 332.5, 332.6, 334.3

[56] References Cited

U.S. PATENT DOCUMENTS

| | | | |
|---|---|---|---|
| 344,933 | 7/1986 | Baldrige et al. | 400/330.7 |
| 444,873 | 1/1891 | Barron | 400/332.6 |
| 456,350 | 7/1891 | Yost | 400/332.2 |
| 672,523 | 4/1901 | Fox et al. | 400/332.6 |
| 711,358 | 10/1902 | Smith | 400/330.5 |
| 712,945 | 11/1902 | Lotterhand | 400/332.6 |
| 727,340 | 5/1903 | Fox et al. | 400/332.6 X |
| 827,044 | 7/1906 | Smith | 400/332.6 |
| 1,041,557 | 10/1912 | Alexander | 400/332.6 |
| 1,841,113 | 1/1932 | Garbell | 400/332.2 |

FOREIGN PATENT DOCUMENTS

| | | | |
|---|---|---|---|
| 1591987 | 7/1981 | United Kingdom | 400/332.5 |

*Primary Examiner*—Ernest T. Wright, Jr.
*Attorney, Agent, or Firm*—Kirschstein, Kirschstein, Ottinger & Israel

[57] ABSTRACT

A typewriter carriage escapement mechanism comprises a rack (10) movable with the typewriter carriage (2) and having two sets of teeth (16 and 18) projecting in opposite directions. An escapement dog (30) has two separate teeth or sets of teeth (44 and 54) arranged to engage the two sets of rack teeth (16 and 18) alternately as the dog (30) moves at right angles to the rack (10), on operation of the keys (90) or space bar (92) of the typewriter. One of the sets of teeth (54) is mounted on a pawl (50) movable relative to the other tooth (44) or set of teeth, to enable both sets of teeth to be disengaged from the rack (10) to release the carriage (2). The pawl (50) is movable against a return spring (70) by means of an actuating rod (80) engaging a lug (62) on the pawl (50). The mechanism of the invention enables a single escapement member (30) to effect both the stepwise movement of the carriage (2) and also the carriage release. The elements of the mechanism need only to be reciprocated in a straight line, so simplifying the construction of the mechanism.

5 Claims, 14 Drawing Figures

TYPEWRITER CARRIAGE ESCAPEMENT MECHANISM HAVING TWO SETS OF TEETH

Figure 1:
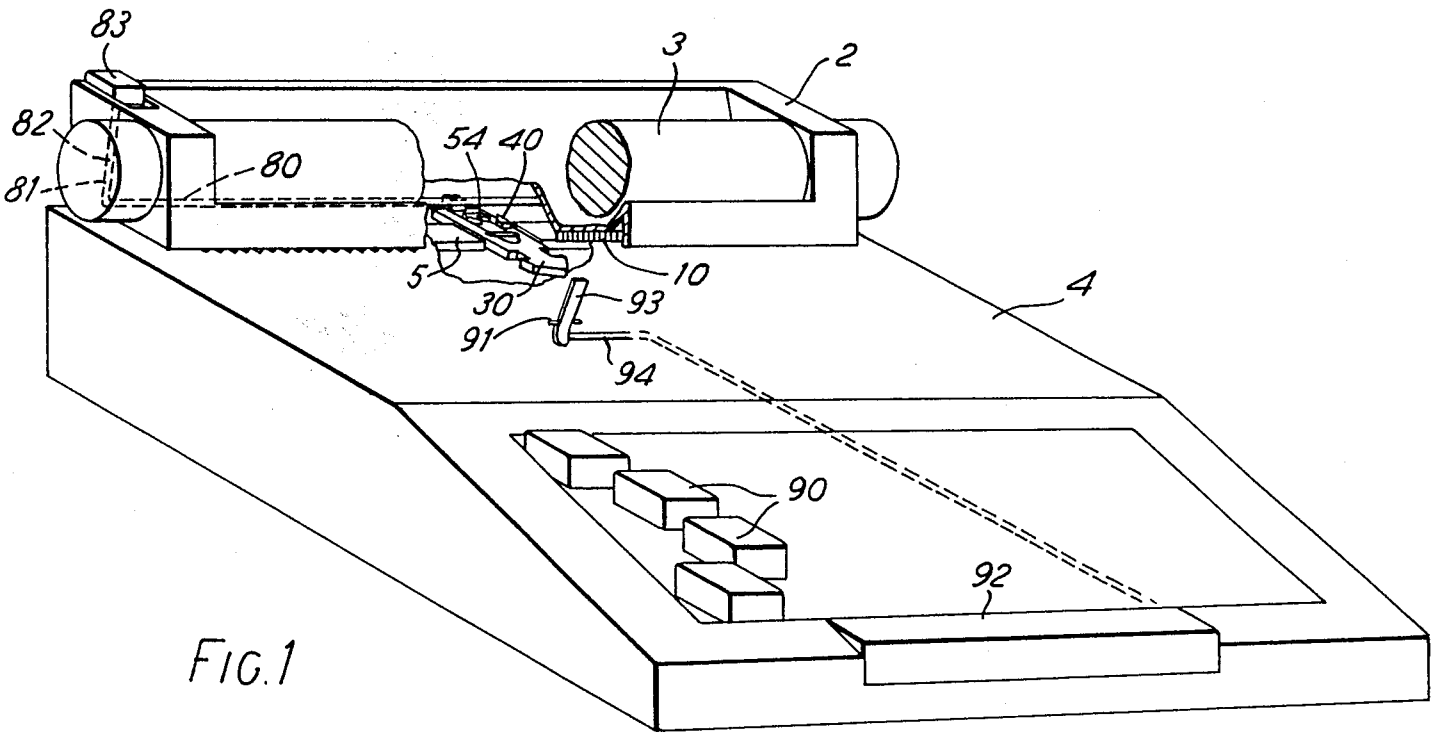

This invention relates to typewriters and in particular to typewriter carriage escapement mechanisms.

In typewriters having a movable carriage on which the platen is supported, the carriage is usually spring-biased to move in one direction, and an escapement mechanism actuated by the typewriter keys allows the carriage to move in steps corresponding to the spacing between characters to be printed. The escapement mechanism usually consists of a rack fixed to and extending the length of the carriage and a dog engaging the rack. A carriage release mechanism is also usually provided, to withdraw the dog from the rack and allow the carriage to move freely on actuation of a lever on the carriage or of a tabulator key.

Known carriage escapements are often complex mechanisms. This is a disadvantage particularly in the manufacture of inexpensive typewriters, such as toy typewriters, where low cost of manufacture and cost of assembly are important considerations.

The invention consists in a typewriter having a carriage and driving means biassing the carriage to move in one direction, and a carriage escapement mechanism comprising a rack movable with the carriage and an escapement member reciprocable between first and second positions in a direction transverse to the direction of movement of the rack, in which the rack has first and second sets of teeth projecting in opposite directions, and the escapement member has first and second teeth arranged so that in the first position of the escapement member the first tooth engages the first set of teeth of the rack and in the second position of the escapement member the second tooth engages the second set of teeth of the rack, the teeth of the escapement member or the first and second sets of teeth of the rack being staggered in relation to one another in the direction of movement of the rack, so that movement of the escapement member between the first and second positions allows the rack to move through a predetermined distance, and in which means are provided to move both teeth of the escapement member out of engagement with the teeth of the rack at the same time to allow the rack to move freely.

Preferably, the first tooth of the escapement member is movable relative to the second tooth, so that when the escapement member is in the first position the first tooth can be moved out of engagement with the rack to allow the rack to move freely.

Suitably, the escapement member comprises a body to which the second tooth is fixed and a pawl carrying the first tooth and slidably mounted in the body for movement parallel to the direction of reciprocation of the escapement member, the pawl being resiliently biassed to a position in which it can engage the rack when the escapement member is in the first position.

In one form of the invention, the two sets of teeth of the escapement rack project away from one another, and the rack moves between the first and second teeth of the escapement member, the first and second teeth being normally spaced apart from one another by a distance, measured in the direction of movement of the escapement member, less than the distance, measured in the same direction, between the crests of the teeth of the first and second sets of the rack.

With the mechanism of this invention, a single escapement member is used to effect both the stepwise movement of the carriage and also the carriage release. The elements of the escapement member need only to be reciprocated in a straight line, so that mounting and actuation of the escapement member can be made very simple.

The invention also includes a carriage escapement mechanism for a typewriter as defined above.

Figure 2:
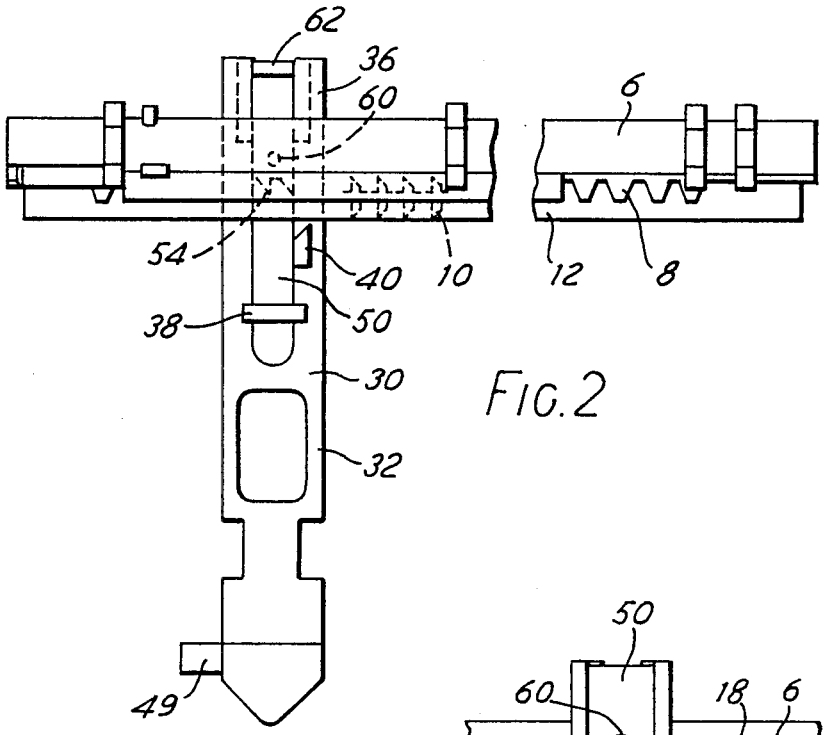
Figure 3:
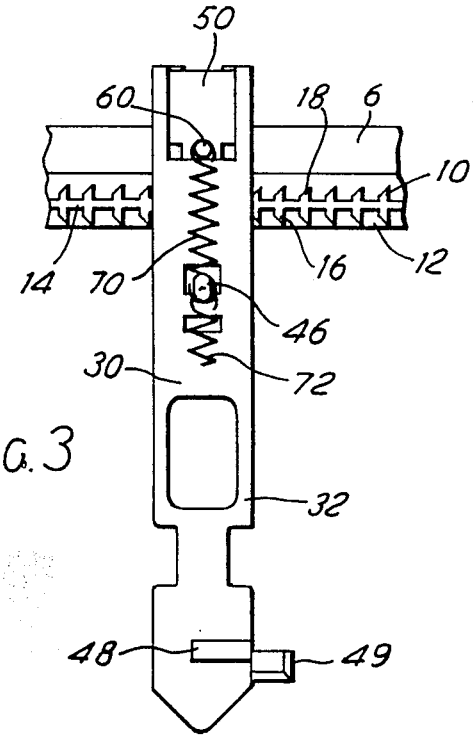
Figure 4:
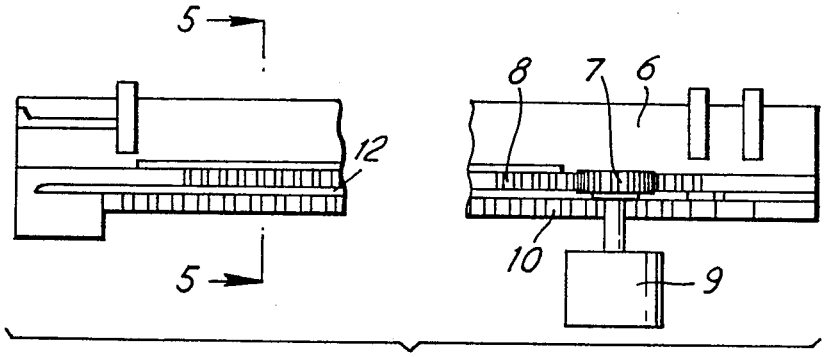
Figure 5:
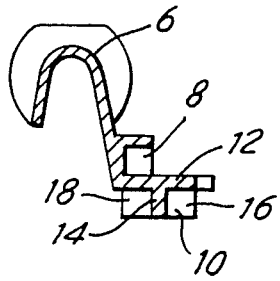
Figure 6:
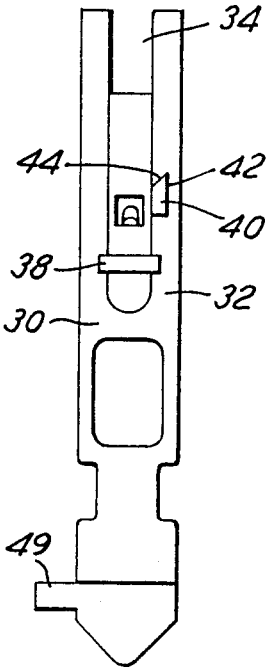
Figure 7:
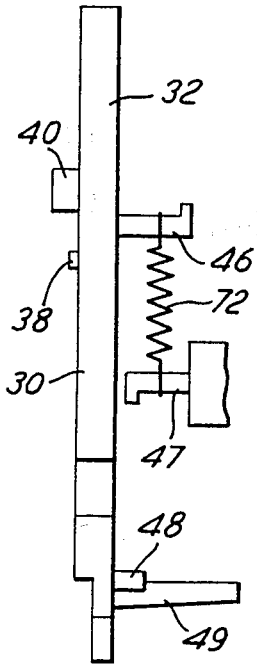
Figure 8:
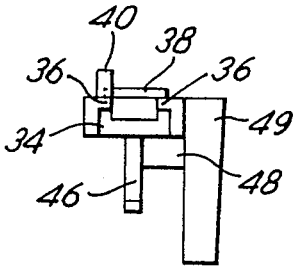
Figure 9:
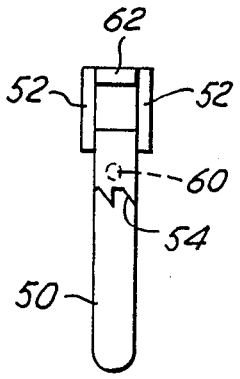
Figure 10:
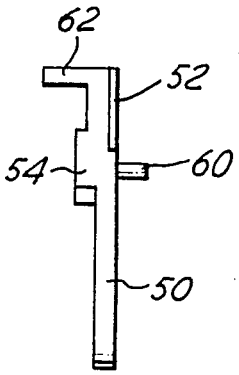
Figure 11:
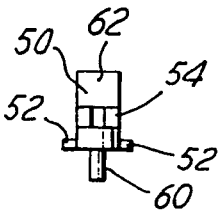
Figure 12:
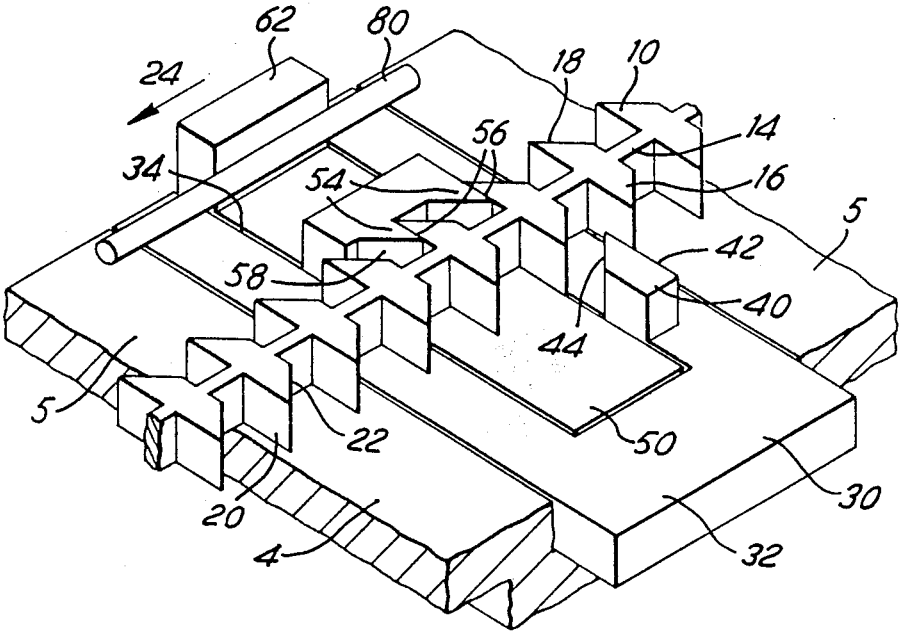
Figure 13:
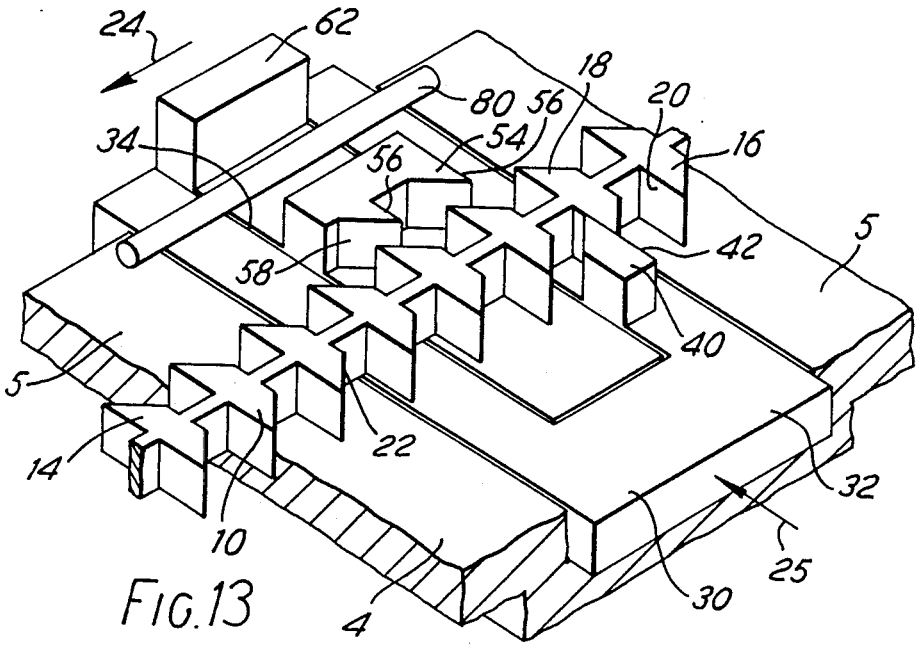
Figure 14:
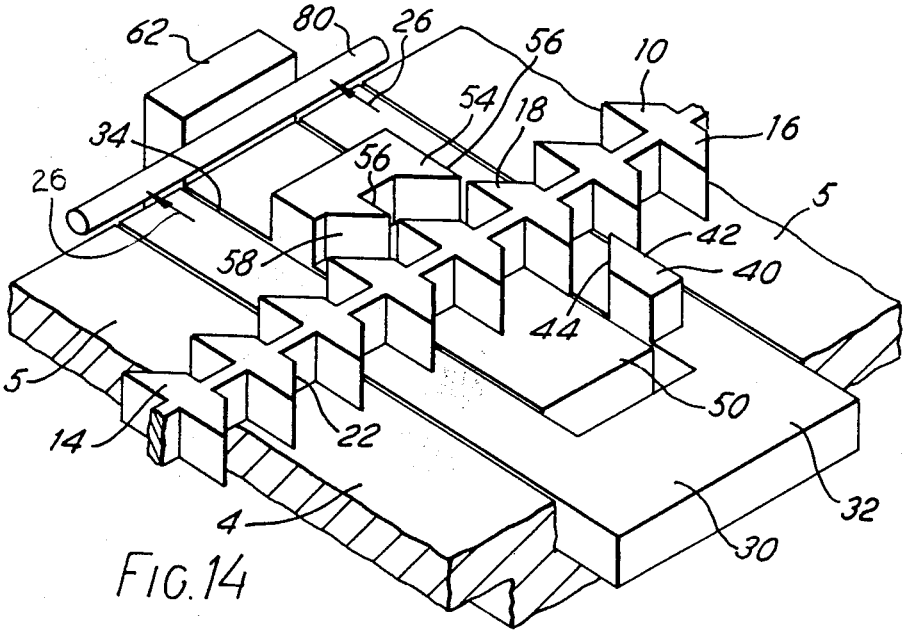

The invention will now be described, by way of example, with reference to the accompanying drawings, in which:

FIG. 1 is a diagrammatic view of a typewriter incorporating a carriage escapement mechanism, in accordance with the invention, FIG. 2 is a plan view of the escapement mechanism, FIG. 3 is an underneath plan view of the escapement mechanism, FIG. 4 is a front elevation of a carriage slide forming part of the mechanism, FIG. 5 is a section on line 5—5 of FIG. 4, FIG. 6 is a side elevation of an escapement dog forming part of the mechanism, FIG. 7 is a plan view of the body of the dog, with the pawl removed, FIG. 8 is an end elevation of the dog, FIG. 9 is a plan view of the pawl, FIG. 10 is a side elevation of the pawl, FIG. 11 is an elevation of the pawl, and FIGS. 12 to 14 are diagrammatic views of the rack and dog, showing the dog in three different positions during operation of the mechanism.

Referring to the drawings, a typewriter has a carriage 2 movable on a body 4. The carriage 2 is mounted on a slide 6, which is movable longitudinally on a runner (not shown) fixed to the body 4 of the typewriter, for example as shown in British patent specification No. 1,591,987. The slide 6 is biassed to move from right to left, as seen in FIG. 1, by a known form of drive mechanism 9 consisting of a spring-loaded pinion 7 engaging a drive rack 8 on the slide 6. Movement of the slide 6, and therefore of the carriage 2, is controlled by an escapement mechanism comprising an escapement rack 10 on the slide 6 and an escapement dog 30, movable in the body 4 of the typewriter.

The escapement rack 10 is formed on the underside of a flange 12 extending forwards from the lower part of the slide 6. The rack 10 has two sets of teeth 16 and 18, extending forwards and backwards respectively on opposite sides of a central stem 14 which extends along the slide 6. Each of the teeth 16 and 18 has a flat face 20 at right angles to the direction of movement of the slide 6 and facing in the direction in which the slide 6 is biased, i.e. right-to-left as seen in FIG. 1, and a face 22 inclined at 45° to the flat face 20.

The escapement dog 30 consists of a body 32 and a pawl 50 slidable in the body 32.

The body 32 is slidable in guides (5) formed in the body 4 of the typewriter so as to be movable horizontally in a direction at right angles to the direction of movement of the carriage slide 6.

The pawl 50 is slidable in a recess 34 formed in the rear part of the body 32 of the dog 30. The pawl 50 is held against upward movement by engagement of flanges 52 on the pawl 50 beneath flanges 36 at the rear of the body 32 and by a bridge member 38 on the body 32 beneath which the forward part of the pawl 50 slides.

A rearwardly directed tooth 40 is formed on the upper face of the body 32 of dog 30, on one side of the slot 34. The tooth 40 has a flat vertical face 42, facing in the direction opposite to the direction in which the carriage slide 6 is biased, and a face 44 inclined at 45° to the flat face 42.

A pair of forwardly directed teeth 54 are formed on the upper face of the pawl 50. Each tooth 54 has a flat vertical face 56, facing in the same direction as the flat face of the tooth 40, and a face 58 inclined at45° to the flat face 56. The spacing between the flat faces 56 of the teeth 54 of the pawl 50 is equal to the interval between the teeth 16 and 18 of the escapement rack 10. The spacing, measured in the direction of movement of the carriage slide 6, between the flat face 42 of the tooth 40 on the body 4 of the dog 30 and the flat face 56 of the nearest tooth 54 of the pawl 50, is equal to approximately half the interval between the teeth 16 and 18 of the escapement rack 10.

When the pawl 50 is in its forwardmost position relative to the body 32 of the dog 30, determined by engagement of the end of the pawl 50 with the forward end of the recess 34, the distance between the teeth 54 of the pawl 50 and the tooth 40 of the dog 30, measured in the direction of movement of the dog 30, is less than the overall distance between the crests of the teeth 16 and the crests of the teeth 18 of the escapement rack 10. the pawl 50 is biased to its forwardmost position by means of a tension spring 70 acting between a downwardly extending post 60 fixed to the pawl 50 and a downwardly extending post 46 on the body 32 of the dog 30. The pawl 50 can be moved rearwards relative to the body 32 of the dog 30 to a position in which the teeth 54 on the pawl 50 are separated from the tooth 40 on the dog 30 by a distance greater than the overall distance between the crests of the teeth 16 and 18 of the escapement rack 10. This movement is effected by means of an actuating rod 80 mounted in the carriage 2 so as to extend between the rack 10 and a lug 62 at the rear end of the pawl 50, in all positions of the carriage 2. The rod 80 is carried by upwardly extending portions 81 pivoted at their mid-points 82 in the carriage 2 so that movement of a carriage release knob 83 engaging the top of one of the portions 81 causes the rod 80 to move rearwardly. On such movement, the rod 80 engages the lug 62 to move the pawl 50 rearwardly.

The dog 30 is positioned beneath the flange 12 of the carriage slide 6, so that the escapement rack 10 extends between the tooth 40 on the body 32 of the dog 30 and the teeth 54 on the pawl 50. The dog 30 is movable between a first position, shown in FIG. 12, in which the teeth 54 of the pawl 50 are engaged between teeth 16 of the rack 10, and a second position, shown in FIG. 13, in which the teeth 40 on the body 32 of the dog 30 is engaged between teeth 18 of the rack 10. The dog 30 is biased to the first position by means of a tension spring 72 acting between the post 46 on the body 32 of the dog 30 and a suitable anchorage point 47 (FIG. 7) on the body 4 of the typewriter. The dog 30 can be moved to the second position against the spring bias by means of a bail (not shown) which bears against the forward end of the dog 30 and which is engaged by the type bars of the typewriter so as to move the dog 30 on depression of any of the corresponding keys 90. The construction and operation of the bail may be similar to that described in the above mentioned British patent specifications No. 1,591,987. In addition, the dog 30 may be moved to the second position by depression of the space bar 92, through a lever (93) which is coupled to the space bar 92 through a rod 94. On depression of the space bar 92, the lever 93 is pivoted on pivot 91 and enages a lug 48 on the body 32 of the dog 30, to push the dog 30 rearwardly.

An arm 49 formed on the body 32 of the dog 30 is positioned to engage a conventional mechanism for lifting the typewriter ribbon to the appropriate position on each actuation of any of the character keys 90 of the typewriter.

In operation, the dog 30 is normally held by the springs 70 and 72 in the position shown in FIG. 12, with the tooth 54 on the pawl 50 engaging between the teeth 18 on the escapement rack 10, so that the carriage slide 6 is held stationary by engagement of the faces 20 of the teeth 18 with the faces 56 of the teeth 54. On depression of a character key 90 or the space bar 92, the dog 30 is moved in the direction of arrow 25, as described above, to the position shown in FIG. 13. As the dog 30 moves to this position, the teeth 54 of the pawl 50 move out of engagement with the teeth 18 of the escapement rack 10, so that the rack 10 is released and moves in the direction of the arrow 24. At the same time the tooth 40 on the dog 30 moves into the path of the teeth 16 of the rack 10, so that movement of the carriage slide 6 is arrested by engagement of the face 20 of one of the teeth 16 with the face 42 of the tooth 40. The carriage 2 is thus held stationary as the corresponding type bar (when a character key 90 is depressed) strikes the platen 3. On release of the character key 90 or space bar 92, the dog 30 is moved back to its initial position by the spring 72, the pawl 50 being held in position relative to the body 32 of the dog 30 by the spring 72. As the dog 30 moves back to its initial position, the rack 10 is again released as the tooth 40 is withdrawn from the rack 10 and moves further to be arrested by engagement of two of the teeth 18 of the rack 10 with the teeth 54 of the pawl 50. The reciprocation of the dog 30 therefore allows the carriage slide 6, and with it the carriage 2, to move through a distance corresponding to the spacing between the teeth 16 on the rack 10.

Actuation of the carriage release knob 83 of the typewriter causes the pawl 50 to be moved relative to the body 32 of the dog 30 in the direction of arrows 26 to the position shown in FIG. 14, against the bias of the spring 70. The spring 70 is weaker than the spring 72 acting on the body 32 of the dog 30, so that the body 32 remains stationary during this movement of the pawl 50. Movement of the pawl 50 withdraws the teeth 54 from engagement with the teeth 18 of the rack 10, so that the rack 10 is free to move between the teeth 54 and the tooth 40. Deactuation of the carriage release knob 83 allows the pawl 50 to be moved back to its initial position by the spring 70.

The bevelled faces 22 on the teeth 16 and 18 of the escapement rack 10, and the correspondingly bevelled faces 58 on the teeth 54 of the pawl 50, allow the carriage 2 to be moved manually in a direction opposite to that of the arrow 24 without the need to actuate the carriage release knob 83, the mutual engagement of the bevelled faces 22 and 58 causing the pawl 50 to reciprocate as the teeth 16 and 18 of the rack 10 ride over the teeth 54 of the pawl 50.

It will be appreciated that changes could be made in the described embodiment within the scope of the invention. For example, the pawl could have one tooth, or more than the two teeth of the described embodiment and the body of the dog could similarly be provided with a number of teeth appropriately spaced. The spacing between the flat face of the tooth on the body of the dog and the flat face of the nearest tooth on the pawl may vary considerably from the spacing in the described embodiment (i.e. equal to half the interval between the teeth of the escapement member). This spacing determines the proportion of each stepwise movement of the carriage which is taken up by the initial movement, on depression of a character key, to the position at which the type bar strikes the platen. The spacing might, for example, be made larger than half the interval between teeth on the escapement member, so that the intial movement of the carriage is smaller than the final movement, on release of the key.

I claim:

1. A typewriter having a carriage and driving means biasing the carriage to move in one direction, and a carriage escapement mechanism comprising:

(a) A rack movable with the carriage, said rack having first and second sets of teeth projecting away from one another on opposite sides of the rack;

(b) An escapement member constrained to slide in a straight line at right angles to the direction of movement of the rack, and movable between first and second positions;

(c) Said escapement member having a tooth arranged to engage the first set of teeth on said rack when said member is in its second position, said tooth moving out of engagement with the rack as said member is moved to its first position;

(d) A pawl slidably mounted in said escapement member for movement relative to said member in a straight line at right angles to the direction of movement of said rack, between first and second positions;

(e) Resilient means biasing said pawl to its first position relative to said escapement member;

(f) Said pawl having a tooth arranged, when said pawl is in its first position and said escapement member is in its first position, to engage the second set of teeth on said rack;

(g) The tooth on said escapement member and the tooth on said pawl, when the pawl is its first position, being spaced apart from one another by a distance, measured in the direction of movement of said member, less than the distance, measured in the same direction, between the crests of the teeth of the first and second sets of teeth of said rack;

(h) The tooth of said escapement member and the tooth of said pawl being so positioned relative to said rack, in the direction of movement of said rack, that movement of said escapement member from its first to its second position allows said rack to move through a first predetermined distance and movement of said escapement member from its second to its first position allows said rack to move through a second prdetermined distance; and (i) Movement of said pawl to its second position relative to said escapement member when said escapement member is in its first position being arranged to withdraw the tooth on said pawl from said rack to allow said rack to move freely.

2. A typewriter as claimed in claim 1, in which the escapement member is resiliently biassed to the first position, and means are provided to move the escapement member to the second position upon actuation of a selected one of character keys and a space bar of the typewriter.

3. A typewriter as claimed in claim 1, in which the teeth of the rack have flat faces which engage corresponding flat faces on the teeth of the escapement member during stepwise movement of the rack, and bevelled faces which engage corresponding faces on the teeth of the escapement member when the carriage is moved manually in a direction opposite to said direction of movement, the bevelled faces allowing the teeth of the escapement member to ride over the teeth of the rack during such movement.

4. A typewriter as claimed in claim 1, in which the escapement member is movable horizontally.

5. A carriage escapement mechanism for a typewriter having a carriage and driving means biasing the carriage to move in one direction, the escapement mechanism comprising:

(a) A rack movable with the carriage, said rack having first and second sets of teeth projecting away from one another on opposite sides of the rack;

(b) An escapement member constrained to slide in a straight line at right angles to the direction of movement of the rack, and movable between first and second positions;

(c) Said escapement member having a tooth arranged to engage the first set of teeth on said rack when said member is in its second position, said tooth moving out of engagement with the rack as said member is moved to its first position;

(d) A pawl slidably mounted in said escapement member for movement relative to said member in a straight line at right angles to the direction of movement of said rack, between first and second positions;

(e) Resilient means biasing said pawl to its first position relative to said escapement member;

(f) Said pawl having a tooth arranged, when said pawl is in its first position and said escapement member is in its first position, to engage the second set of teeth on said rack;

(g) The tooth on said escapement member and the tooth on said pawl, when the pawl is its first position, being spaced apart from one another by a distance, measured in the direction of movement of said member, less than the distance, measured in the same direction, between the crests of the teeth of the first and second sets of teeth of said rack;

(h) The tooth of said escapement member and the tooth of said pawl being so positioned relative to said rack, in the direction of movement of said rack, that movement of said escapement member from its first to its second position allows said rack to move through a first predetermined distance and movement of said escapement member from its second to its first position allows said rack to move through a second predetermined distance; and (i) Movement of said pawl to its second position relative to said escapement member when said escapement member is in its first position being arranged to withdraw the tooth on said pawl from said rack to allow said rack to move freely.

* * * * *